US005584334A

United States Patent [19]

Oswald et al.

[11] Patent Number: 5,584,334

[45] Date of Patent: Dec. 17, 1996

[54] METHOD OF INCREASING STRENGTH OF CAST ALUMINUM COMPONENTS

[75] Inventors: James L. Oswald, Redford; Paul M. LeTarte, Troy; Paul A. Ballas, Dearborn; David L. Mitchell, Novi, all of Mich.

[73] Assignee: Ford Motor Company, Dearborn, Mich.

[21] Appl. No.: 350,294

[22] Filed: Dec. 6, 1994

[51] Int. Cl.[6] ..... B22D 27/20

[52] U.S. Cl. ..... 164/57.1; 164/58.1; 164/136

[58] Field of Search ..... 164/57.1, 58.1, 164/136

[56] References Cited

U.S. PATENT DOCUMENTS

| | | | |
|---|---|---|---|
| 3,961,995 | 6/1976 | Alliot et al. . | |
| 5,057,150 | 10/1991 | Reeve et al. . | |
| 5,100,618 | 3/1992 | Dewing et al. . | |
| 5,163,500 | 11/1992 | Seaton et al. | 164/337 |

FOREIGN PATENT DOCUMENTS

| | | | |
|---|---|---|---|
| 61-37359 | 2/1986 | Japan | 164/57.1 |
| 63-281765 | 11/1988 | Japan | 164/57.1 |
| 1305195 | 4/1987 | U.S.S.R. | 164/58.1 |

*Primary Examiner*—Kuang Y. Lin
*Attorney, Agent, or Firm*—Joseph W. Malleck

[57] ABSTRACT

A method in particular, comprises the steps of: (a) preparing a mold having a sprue leading to a substantially horizontally oriented runner, at least one riser extending from the runner, and walls defining a mold cavity in communication with the riser; (b) providing a shallow reaction chamber in the runner containing grain refining inoculant solids therein, the inoculant having a surface exposed substantially tangentially to the flow of molten metal through the runner; (c) pouring a charge of molten aluminum into the sprue with a sufficient pressure head to fill the cavity, the flow being substantially laminar through the runner; and (d) inverting the mold substantially immediately after mold filling and prior to solidification of the metal in the mold cavity.

5 Claims, 3 Drawing Sheets

METHOD OF INCREASING STRENGTH OF CAST ALUMINUM COMPONENTS

BACKGROUND OF THE INVENTION

1. Technical Field

This invention relates to the technology of inoculating aluminum castings with grain refining agents and particularly to the manner of inoculation that eliminates contaminants, reduces the required amount of inoculant, and achieves an improved distribution of inoculant without need for augmented circulation.

2. Discussion of the Prior Art

As aluminum engine blocks are designed for higher stressed applications, microstructures of conventional aluminum alloys may not withstand the imposed loads over increasingly longer useful lives for the blocks, particularly at high stress locations such as integral crankshaft bearing yokes.

The prior art as heretofore attempted to improve the yield strength of aluminum alloys by bath inoculation of molten aluminum with small amounts of titanium and boron to achieve a finer grain size of the cast microstructure. Unfortunately, such open bath inoculation, prior to pouring of the molten metal, allows ingress of contaminants, allows the inoculant to settle in the bath as sludge, and requires an excessive amount of inoculant to ensure dissolvement throughout all of the charge of aluminum and to overcome the fading of the inoculant with time. Moreover, bath inoculation is demonstratably a high cost method.

Applicant is unaware of any attempts to inoculate a molten aluminum casting charge in its path from the pouring basin or holding crucible to the mold, except by use of a wire feed inoculant pointed into the aluminum stream to be progressively melted. Wire inoculation is expensive and permits contamination by films adhering to the surface of the wire.

Titanium and boron have been introduced to a stream of pure aluminum metal for creating grain refining bars which bars are later used to inoculate a molten bath. Unfortunately, such teaching has little to do within the mold inoculation of the final casting charge. In these inoculant- bar-forming techniques, powder titanium and/or boron is dumped into the stream of aluminum usually in an open trough, which technique fails to overcome many of the problems of bath inoculation.

SUMMARY OF THE INVENTION

It is an object of this invention to provide a method of making fine grained aluminum castings that uses less inoculant, is fool-proof, and produces a casting having an average grain size of ASTM 11.5 to 14.5 (0.6 to 0.23 mm) and reduced volume of micro porosity.

The method in particular, comprises the steps of:

(a) preparing a mold having a sprue leading to a substantially horizontally oriented runner, at least one riser extending from the runner, and walls defining a mold cavity in communication with the riser;

(b) providing a shallow reaction cheer in the runner containing grain refining inoculant solids therein, the inoculant having a surface exposed substantially tangentially to the flow of molten metal through the runner;

(c) pouring a charge of molten aluminum into the sprue with a sufficient pressure head to fill the cavity, the flow being substantially laminar through the runner; and (d) inverting the mold substantially immediately after mold filling and prior to solidification of the metal in the mold cavity.

DETAILED DESCRIPTION AND BEST MODE

Figure 1:
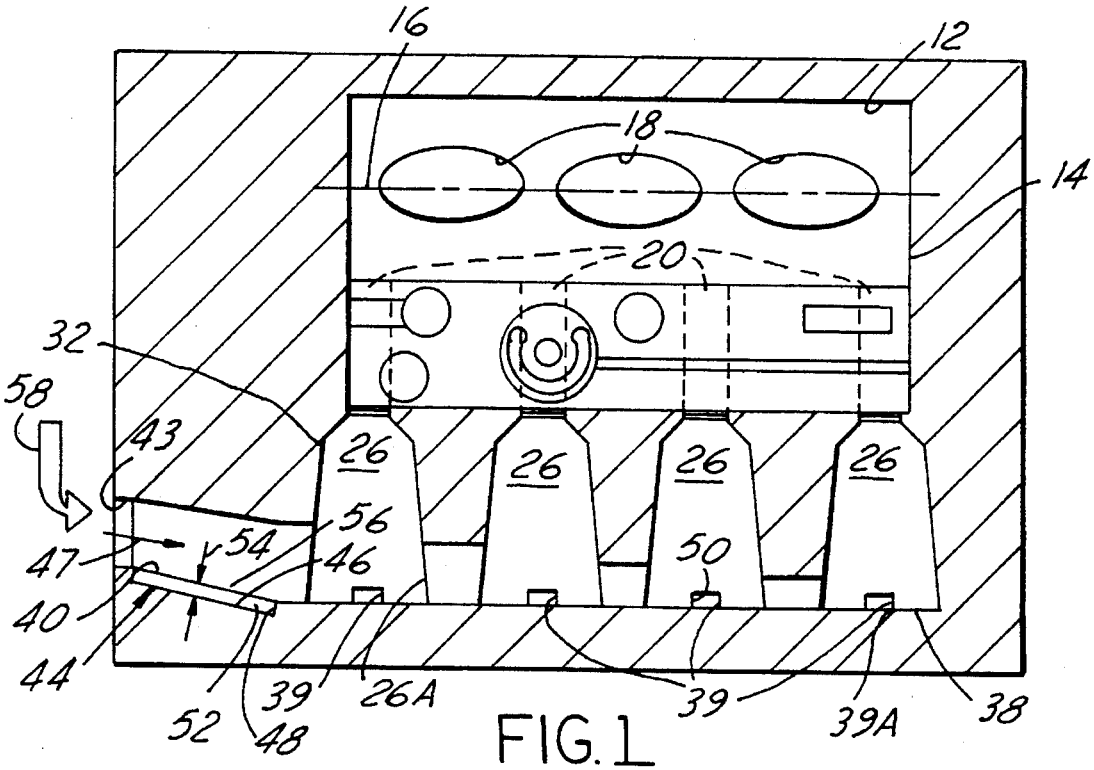
FIG. 1 is a central sectional elevation view of a mold assembly relative to a pouring basin inoculation bars in place.
Figure 2:
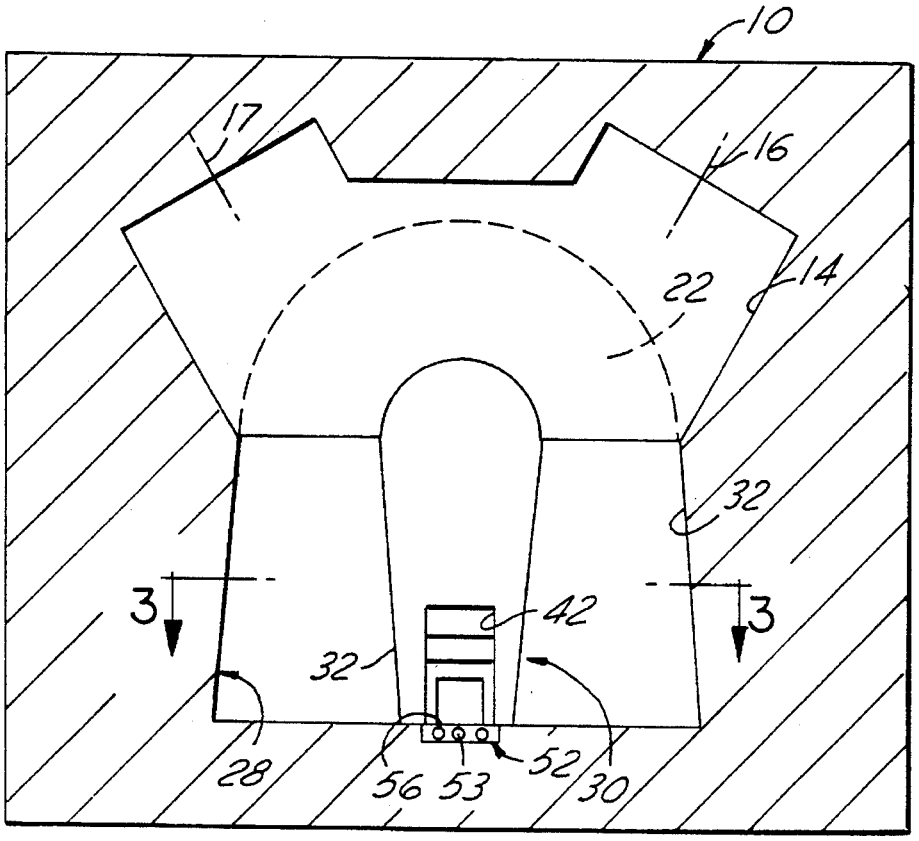
FIG. 2 is an end view of the structure shown in FIG. 1.
Figure 3:
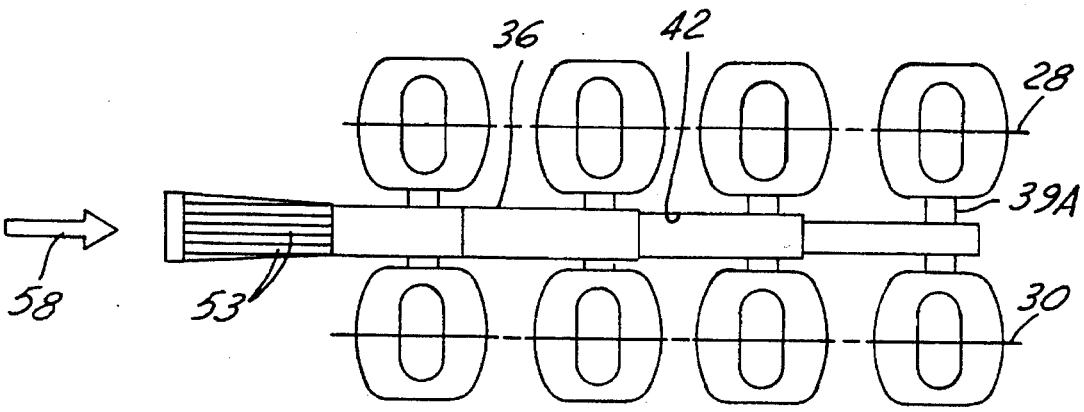
FIG. 3 is a sectional view taken substantially along line 3—3 of FIG. 2.

As shown in FIG. 1, a mold 10 is comprised of a series of resin bonded sand walls 12 defining an interior cavity 14. The cavity 14 is for a V-shaped internal combustion engine block having spaces for two banks 16,17 each containing a plurality of cylinder bores 18; the cavity defines spaces for bulkheads 20 disposed between and extending transversely= to the line of cylinder bores. The spaces for the bulkheads have a half yoke space 22 defining, in part, a crankshaft bearing which must withstand high concentrations of stress during engine operation. The bulkheads are among the largest wall thicknesses of the casting mass and have a lateral dimension 24 which is usually in the range of about 20–28 mm thick.

Connected to the mold cavity, essentially at the base of each bulkhead wall, is a series of walls defining risers 26 placed in two rows 28,30. Each riser has a generally vertically oriented passage 32 of conical shape. A generally horizontally extending runner system 34 is disposed between the rows of risers which includes walls defining an elongated primary runner 36 with smaller lateral runners 39 extending to the base 38 of each riser. The walls for the primary runner extend substantially along the length of the mold 10 and away from the mold at 40, as shown in FIG. 1. The runner walls are typically comprised of resin bonded sand. The cross sectioned sides 42 of the interior of the runner walls sequentially reduce as the runner proceeds from its entrance 43 to its last lateral runner 39A. The cross sections are designed to promote a uniform fill of all risers simultaneously and are proportioned to the volume of molten metal to be charged to permit the charge metal to empty through the runner system within a prescribed period of time, such as 90 seconds for a 100 pound aluminum charge.

An inoculant reaction chamber 44 is formed in the interior sides of the horizontal runner (here bottom wall 46) and is positioned as close as possible to the first riser 26A along the flow 47 (see end of chamber at 48 against lateral runner side 50). The chamber 44 is recessed in wall 46, to a depth 54 of about ⅜ of an inch and shaped to snugly receive the solid mass of inoculant 52. The solid mass 52 is desirably one or more bars 53 made of pre-cast inoculant alloy metal. The bars are submerged in the reaction chamber to present a surface 56 oriented tangentially to the flow 47 of the molten aluminum passing through the runner. Such surface 56 should have an area that is minimized, within controlled limits, to prevent shock chilling of the molten flow which can result in premature freeze off of the molten metal in some areas of the casting. Preferably the area of surface 56 is in the range of 5–7 square inches for a 100 pound molten charge.

The inoculant material 52 consists of an aluminum alloy containing, by weight, 5–10% titanium and 0.75–1.25% boron, with the remainder being essentially aluminum except for up to 0.5% impurities. The mass of the inoculant 52 is proportioned to the volume or mass of the molten aluminum charge so that it is in the ratio of about one gram to one pound. The inoculant must be in sufficient quantity to ensure, when nucleated throughout the casting, a microstructural grain size in the range of ASTM 11.5 to 14.5.

An aluminum charge 58 is poured into the sprue leading to runner entrance 43 at a temperature of about 760° C. and with a pressure head sufficient to fill the cavity 14 in the mold. The flow 47 should be substantially laminar if the runner system is contoured correctly to avoid turbulence. The laminar flow 47 passes over and along the exposed surface 56 of the inoculant body 52, creating the timed dissolution of the inoculant. The pour should consume a period of about 90 seconds. Boron will first fold non-metallic inert compounds in the aluminum molten flow; these first particles will nucleate the formation of non-metallic titanium compounds therearound and such intermetallic second stage particles will nucleate very fine grained aluminum. Atoms of a liquid or gaseous state are normally in a random order whereas atoms in a solid state are normally in a fixed crystallographic order. Nucleation is the process where random atoms solidify and assume a regenerated crystal structure; the non-metallic inoculants provide an origin point for crystallographic structure to grow. If the pour temperature is excessively above 760°, the sand mold walls will be burned; if the pour temperature is too low, the metal may possess defects where two cold fronts join.

Figure 4:
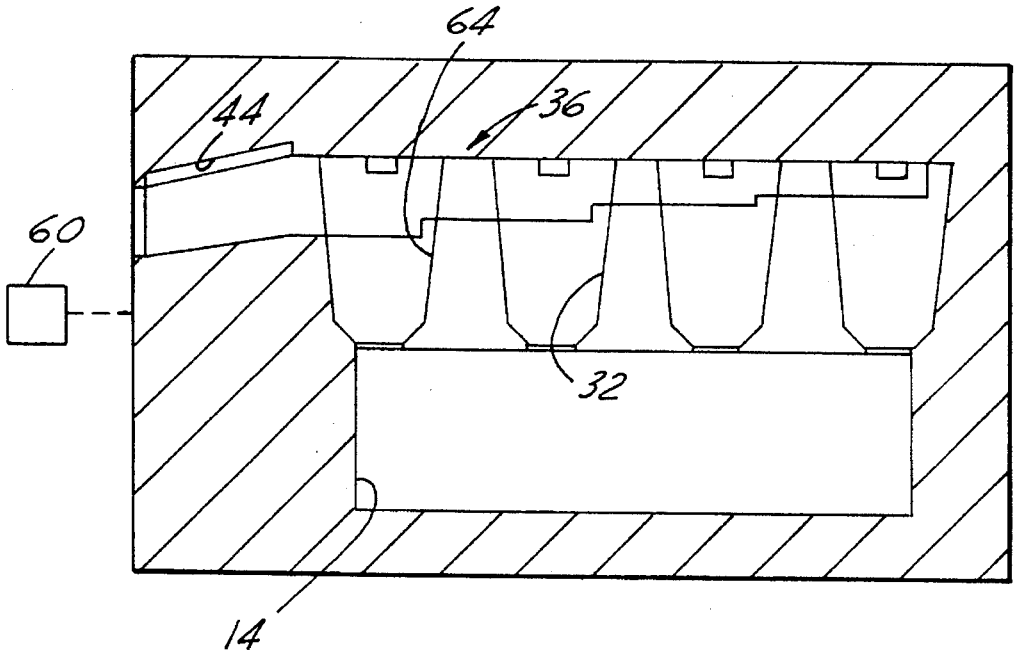
FIG. 4 is a sectional view of the mold assembly of FIG. 1, but inverted for solidifying the molten metal.

It takes about 12 minutes for a 100 pound charge to fully solidify in the sand mold. Since only one side of the laminar flow 47 sees the inoculant during dissolution, there must be mixing of the non-metallic compound particles throughout the melt to assure a properly distributed fine grain solidification structure. To this end, the mold 10 is inverted or rotated immediately after filling by use of an apparatus 60 (see FIG. 4), disclosed more fully in U.S. Pat. No. 5,163,500 (assigned to the assignee of this invention), the disclosure of which is incorporated by reference. As the metal freezes in the cavity 14 in the inverted position 62, additional metal is quiescently fed to the cavity 14 from the inverted risers which now can act as fill gates 64 to accommodate shrinkage. Since the fill stage takes about 1.5 minutes, there remains about 10.5 minutes for the molten metal to fully freeze in the inverted condition. During this 10.5 minute period, chemical equilibrium will force mixing of the intermetallic compounds to assure a very fine microstructure. Chemical equilibrium causes mixing because liquids and gases seek to evenly fill their containment.

The resulting aluminum casting will possess a tensile strength of about 30 ksi, and elongation of 2.5–0.5 varying with respect to the grain size of ASTM 11.5 to 14.5, a yield strength of 27–29.5 ksi varying also in accordance with the grain size of such range, and fatigue strength will improve. The microstructure will possess a volume porosity of less than 1%, with porosity points of 0.002–0.003 inches. Porosity is reduced or eliminated by the homogenous distribution of fine grains. This reduces the number of fatigue sites that will contribute to a reduction of fatigue cracks. Fatigue cracks will initiate at points of porosity and propagate along grain boundaries with copper segregation (brittle phases). With segregation reduced and porosity points reduced, fatigue strength is increased. In addition, dendrite average arm spacing is desirably about 72 microns. This is important because ultimate tensile strength is inversely proportional to dendrite arm spacing.

Figure 5:
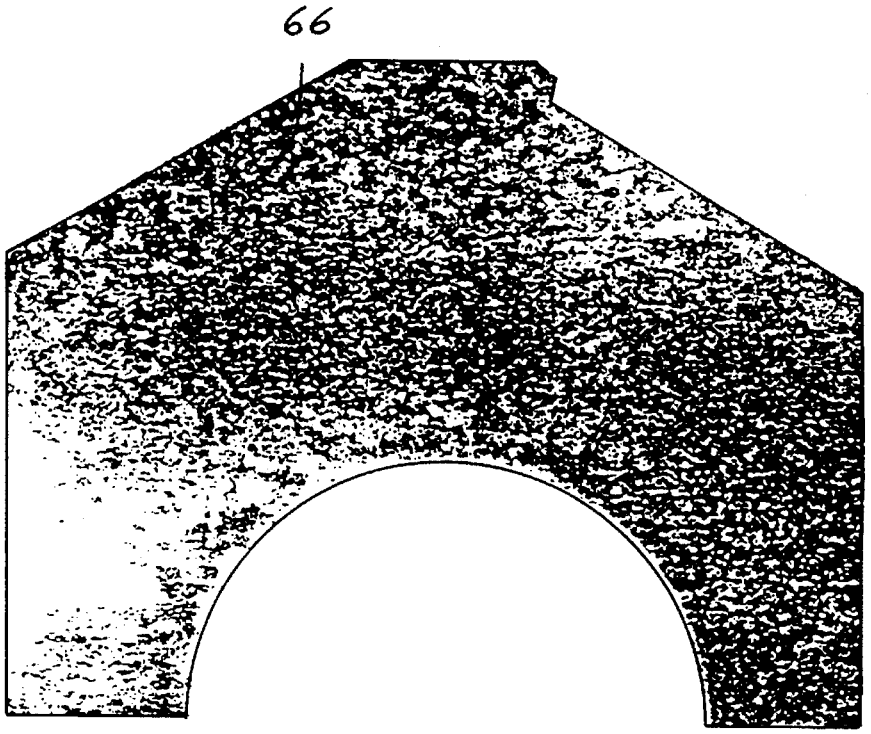
FIGS. 5 and 6 are enlarged etched sections of a casting surface (6× magnification) to exhibit macrograin structure of such casting first made without this invention, and the other made in conformity with this invention.
Figure 6:
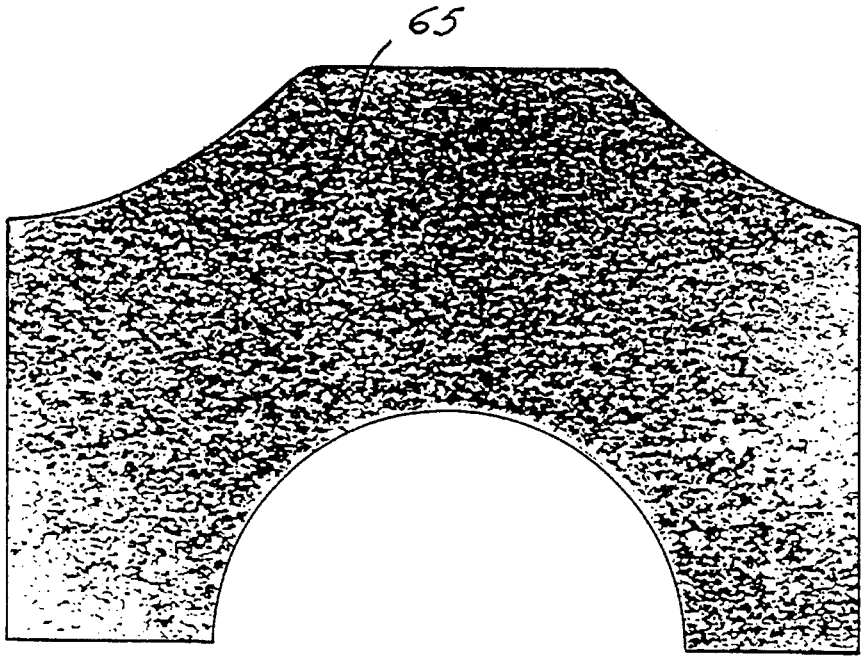

Shown in FIG. 5 is the nonuniform large grain size 66 of a conventionally non-inoculated aluminum casting; FIG. 6 shows very uniform smaller grain size 68 of an aluminum casting inoculated in accordance with this invention. The difference in grain sizes is very apparent.

As is evident from the foregoing description, certain aspects of the invention are not limited to the particular details of the examples illustrated, and it is therefore contemplated that other modifications and applications will occur to those skilled in the art. It is accordingly intended that the claims shall over all such modifications and applications as do not depart from the true spirit and scope of the invention.

We claim:

1. A method of inoculating aluminum castings to increase strength comprising:

(a) preparing a mold having a sprue leading to a substantially horizontally oriented runner, at least one riser extending upwardly from said runner, and said mold having walls defining a cavity above said risers and in communication with the risers;

(b) providing a shallow reaction chamber in a side of said runner containing grain refining solid inoculant therein, said inoculant having a surface exposed substantially tangentially to the flow of molten metal through said runner;

(c) pouring a charge of molten aluminum into said sprue with sufficient pressure head to fill such cavity, said flow being substantially laminar through said runner; and (d) inverting said mold substantially immediately after mold filling and prior to solidification of metal in said mold cavity.

2. The method as in claim 1, in which said reaction chamber is shaped to have an end positioned adjacent the lead riser, said chamber having a depth of about ⅜ of an inch.

3. The method as in claim 1, in which the pour temperature in step (c) is about 760° C. and the time of pour is regulated to be about 90 seconds.

4. The method as in claim 1, in which said solid inoculant is comprised of an aluminum alloy body containing 5–10% titanium and 0.75–1.25% by weight boron with the remainder essentially aluminum.

5. The method as in claim 1, in which said surface of said solid inoculant has an area in the range of 5–7 square inches proportioned for a molten aluminum charge of about 100 pounds.

* * * * *